US008468731B2

(12) United States Patent
Phair

(10) Patent No.: US 8,468,731 B2
(45) Date of Patent: Jun. 25, 2013

(54) MUZZLELOADING RIFLE WITH BREECH PLUG HAVING PRIMER SEAL FACILITY

(75) Inventor: Douglas B. Phair, Miles City, MT (US)

(73) Assignee: Western Powders, Inc., Miles City, MT (US)

( * ) Notice: Subject to any disclaimer, the term of this patent is extended or adjusted under 35 U.S.C. 154(b) by 125 days.

(21) Appl. No.: 13/065,565

(22) Filed: Mar. 24, 2011

(65) Prior Publication Data

US 2012/0240440 A1 Sep. 27, 2012

(51) Int. Cl.
*F41C 7/00* (2006.01)

(52) U.S. Cl.
USPC ..... 42/51; 89/1.3

(58) Field of Classification Search
USPC ..... 42/51; 89/1.3
See application file for complete search history.

(56) References Cited

U.S. PATENT DOCUMENTS 4,227,330 A * 10/1980 Chapin ..... 42/77
4,232,468 A * 11/1980 Chapin ..... 42/77
4,437,249 A * 3/1984 Brown et al. ..... 42/51
5,133,143 A * 7/1992 Knight ..... 42/51
5,511,334 A * 4/1996 Ball et al. ..... 42/51

* cited by examiner

*Primary Examiner* — Samir Abdosh
(74) *Attorney, Agent, or Firm* — Bennet K. Langlotz; Langlotz Patent & Trademark Works, Inc.

(57) ABSTRACT

A firearm having a barrel with a bore on a bore axis, with the barrel having a muzzle end and a breech end. A frame is connected to the barrel and has a breech face. The barrel moves between an open position in which the breech face is away from the breech end of the barrel and a closed position in which the breech face abuts the breech end of the barrel and/or the breech plug's rear face. A breech plug is removably attached to the barrel. The breech plug includes a central passage that communicates between the primer and the flash hole. The passage forms a primer pocket at the breech end of the breech plug. The primer pocket has a diameter greater than the central passage. A circumferential groove in the primer pocket receives an O-ring. The O-ring encompasses the primer's cylindrical exterior to create a seal.

20 Claims, 3 Drawing Sheets

MUZZLELOADING RIFLE WITH BREECH PLUG HAVING PRIMER SEAL FACILITY

FIELD OF THE INVENTION

The present invention relates to firearms, and more particularly to muzzleloading firearms.

BACKGROUND OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged rear bore portion of the barrel at the breech end. In some rifles, the breech plug is not meant to be removed. In others, the breech plug can be removed to facilitate cleaning of the breech plug and rifle bore.

Many different styles of breech plugs have been developed for muzzleloading firearms. A properly designed breech plug should seal the primer by having minimal tolerance between the primer seat and the breech face. The breech plug should also effectively facilitate efficient flow of the flame and gas through the flash hole by including a proper transition angle between the flash channel/fire channel to the flash hole. Failure to meet any or all of these requirements may cause poor ignition, inconsistent accuracy, or hangfires and misfires.

Prior art breech plugs are known to sometimes provide a loose fit when the primer is installed in the primer pocket. The looser the primer fit (circumferentially or longitudinally), the greater the blowback, which makes it less likely that sufficient flame and gas will flow from the primer to the powder. The loose fit results in a measurable loss of energy back through the primer pocket along the walls between the primer and the primer pocket walls. The rearwardly escaping gases leave excessive fouling in the breech area, and these gases can also exit the gun, causing damage to the scope and posing a danger to the shooter. Finally, a loose fitting primer can inconvenience the shooter by falling out of the primer pocket if the breech is open.

Therefore, there is a need for a muzzleloading firearm with a breech plug having a primer seal facility that effectively prevents or minimizes the flame and hot gases from the primer escaping rearward from the primer pocket.

Although prior art breech plugs are known to employ O-rings, those O-rings are typically circumferentially attached the breech plug in a manner to contain the high pressure of powder ignition to prevent fouling of breech plug threads. These prior art breech plug O-rings are either made of rubber or are metal gas check piston rings.

It is also known to place an O-ring into the primer hole against the primer seat at the front of the primer such that when the breech is closed, the primer is forced into the O-ring to create a better seal. However, the O-ring is not held in place within the breech plug when the primer is not present.

SUMMARY OF THE INVENTION

The present invention provides an improved muzzleloading firearm, and overcomes the above-mentioned disadvantages and drawbacks of the prior art. As such, the general purpose of the present invention, which will be described subsequently in greater detail, is to provide an improved muzzleloading firearm that has all the advantages of the prior art mentioned above.

To attain this, the preferred embodiment of the present invention essentially comprises a firearm that has a barrel with a bore on a bore axis, and the barrel has a muzzle end and a breech end. A frame is connected to the barrel and has a breech face. The barrel moves between an open position in which the breech face is away from the breech end of the barrel and a closed position in which the breech face abuts the breech end of the barrel and/or the breech plug's rear face. A breech plug is removably attached to the barrel. The breech plug includes a central passage (flash channel/fire channel) that communicates between the primer and the flash hole. The passage forms a primer pocket at the breech end of the breech plug. The primer pocket has a diameter greater than the central passage. A circumferential groove in the primer pocket receives an O-ring. The O-ring encompasses the primer's cylindrical exterior to create a seal. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
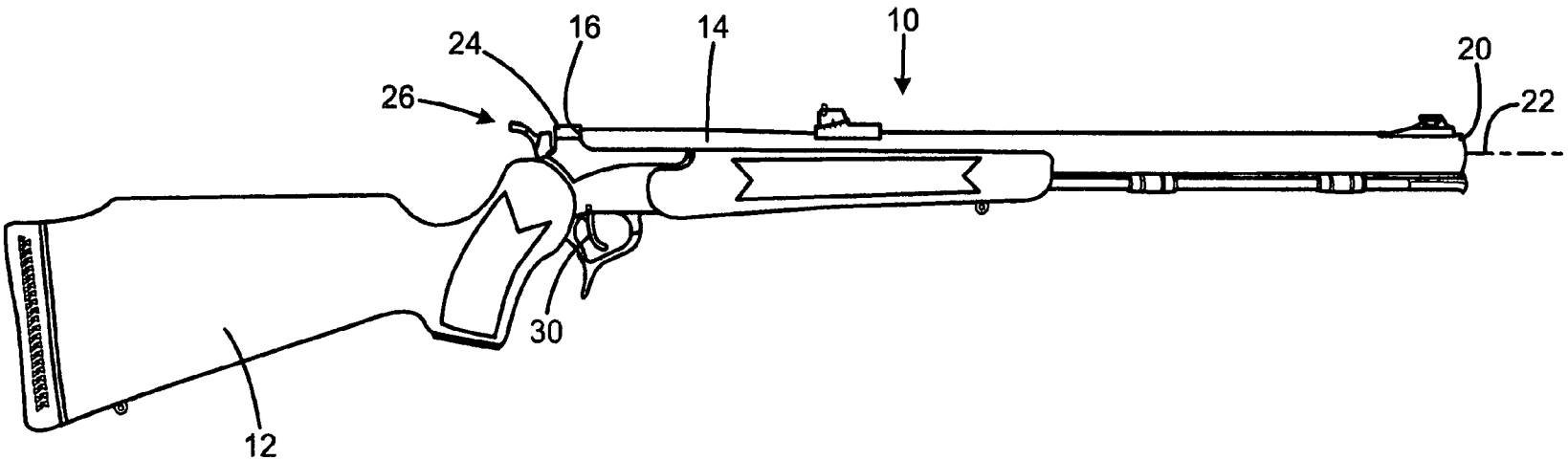
FIG. 1 is a side view of a firearm constructed in accordance with the principles of the present invention.

A preferred embodiment of the muzzleloading firearm of the present invention is shown and generally designated by the reference numeral 10.

FIG. 1 illustrates an improved muzzleloading firearm of the present invention. More particularly, the muzzle-loading firearm 10 has a stock 12 and a barrel 14. The barrel 14 has a breech end 16 and a muzzle end 20, and also has a bore defining a bore axis 22. The breech end of the barrel is pivotally attached to a breech element 24, which enables the barrel to pivot between an open position and a closed (shown) position. A hammer 26 is pivotally connected adjacent the breech block to operate in response to operation of a trigger 30 as will be discussed below. A muzzle loading firearm having some similar features is disclosed in U.S. Pat. No. 6,604,311 to Laney et al., the disclosure of which is incorporated herein by reference.

Figure 2:
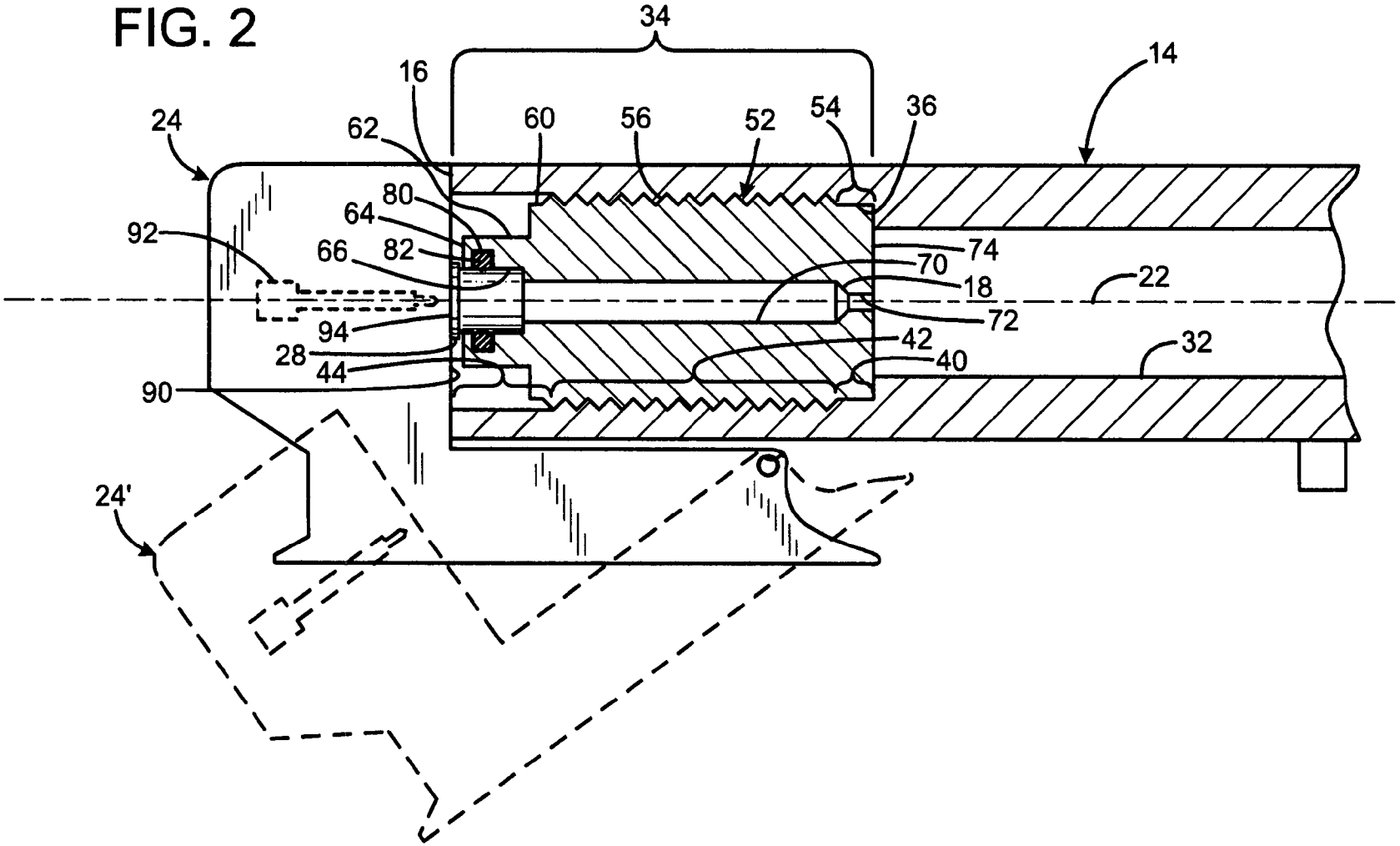
FIG. 2 is a sectional side view of the firearm of FIG. 1 with a breech plug of the present invention installed.

FIG. 2 shows the firearm with which the breech plug of the current invention operates with a breech plug 52 of the current invention at the breech end 16 of the barrel 14. More particularly, the breech plug 52 is identical to a conventional breech plug except for certain features of its central bore. The barrel defines a rifled bore 32 (rifling not shown) that extends from the muzzle nearly the length of the barrel, except for a rear portion 34. The rear portion of the barrel defines an enlarged breech plug chamber 36 having a stepped initial portion 40, an internally threaded' intermediate portion 42, and an enlarged clearance portion 44.

The rear portion of the barrel is occupied by a breech plug 52 of the current invention. The breech plug is a generally cylindrical body with a nose portion 54 that is not threaded to closely fit in the initial portion 40 of the breech plug chamber 36. Most of the length of the plug is provided with helical threads 56, or an alternative fastening element that provides extreme resistance to axial extraction forces, such as those generated by firing a shot. The plug has a narrow flange 60 that is not threaded located directly behind the threads. The rear or breech end portion of the breech plug has a hexagonal profile portion 62 in the shape of a bolt head that may be engaged by a 7/16 inch socket wrench for removing and replacing the plug. The breech plug's hex portion terminates in a flat rear face 64.

The breech plug 52 defines a central bore having a primer pocket 66 at the breech end, a flash channel or fire channel 70 extending from the primer pocket through most of the length of the plug, and a narrow passage or flash hole 72 extending from the flash channel to the forward face 74 of the breech plug. The primer pocket is generally cylindrical to fit a standard Shotshell or muzzleloading 209 primer 94 for a muzzle loading rifle. The transition 18 from the flash channel to the flash hole 72 has a shallow included angle typically ranging from 118° to 135°.

The breech plug 52 further defines a circumferential groove 80 in the interior side wall of the primer pocket 66. The groove receives an O-ring 82. In the current embodiment, the groove has a width of 0.0660 inches and a height of 0.0750 inches. The rearward most portion of the groove is preferably located about 0.080 inches in front of the rear face 64. However, the groove can be located anywhere along the length of the primer pocket. The O-ring encompasses the primer's cylindrical exterior forward of the primer's flange 28 to create a seal, thereby preventing gases and flame from escaping rearwards past the primer. In the current embodiment, the O-ring is a Parker O-Ring 2-010 made of silicone elastomer manufactured by Parker Hannifin Corp of Cleveland, Ohio having an interior diameter of 0.239 inches and a width of 0.070 inches. Thus, the groove has an axial width nominally about the diameter of the O-ring, and a radial depth less than the diameter of the O-ring, which causes the O-ring to effectively decrease the diameter of the primer pocket where the O-ring bulges beyond the groove. This narrowing of the primer pocket's diameter from 0.246 inches to 0.236 inches enables the O-ring to firmly retain the primer, which has a diameter of 0.240 inches, within the primer pocket.

The breech element 24 is shown in the closed position in solid lines, and has a breech face 90 that abuts the barrel breech 16 and/or the breech plug's rear face 64 when closed. This provides a rear surface to fully enclose the primer pocket. A bore in the breech element along the bore axis 22 receives a firing pin 92 that is struck by the hammer 26 to fire the rifle, forcing the tip of the firing pin into a primer, which sends ignition gases and particles through the breech plug bore, to ignite-propellant in the barrel. The breech element is shown with the barrel pivoted into the open position in dashed lines 24'.

Figure 3:
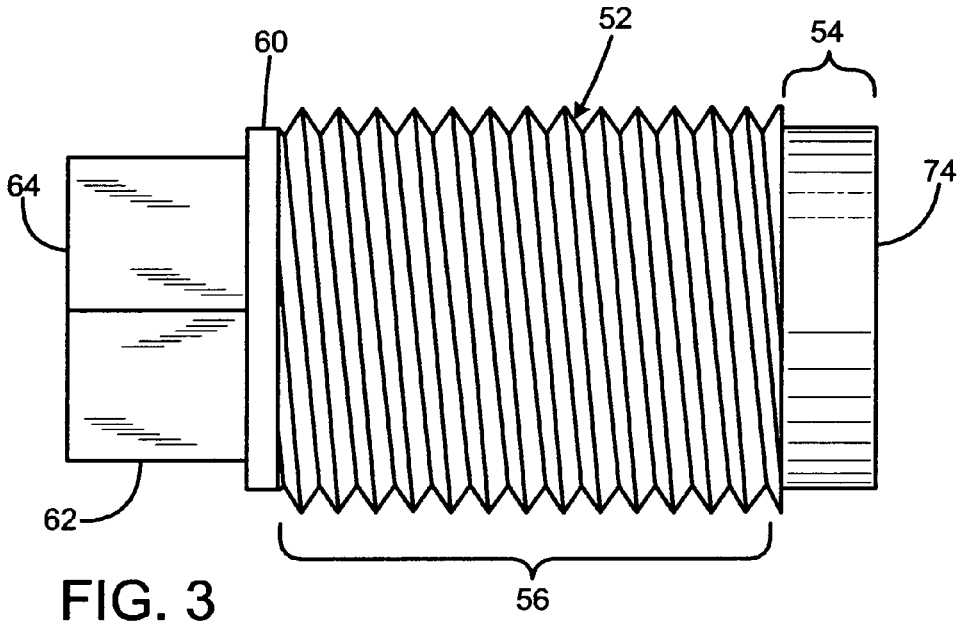
FIG. 3 is a side view of the breech plug of FIG. 2.
Figure 4:
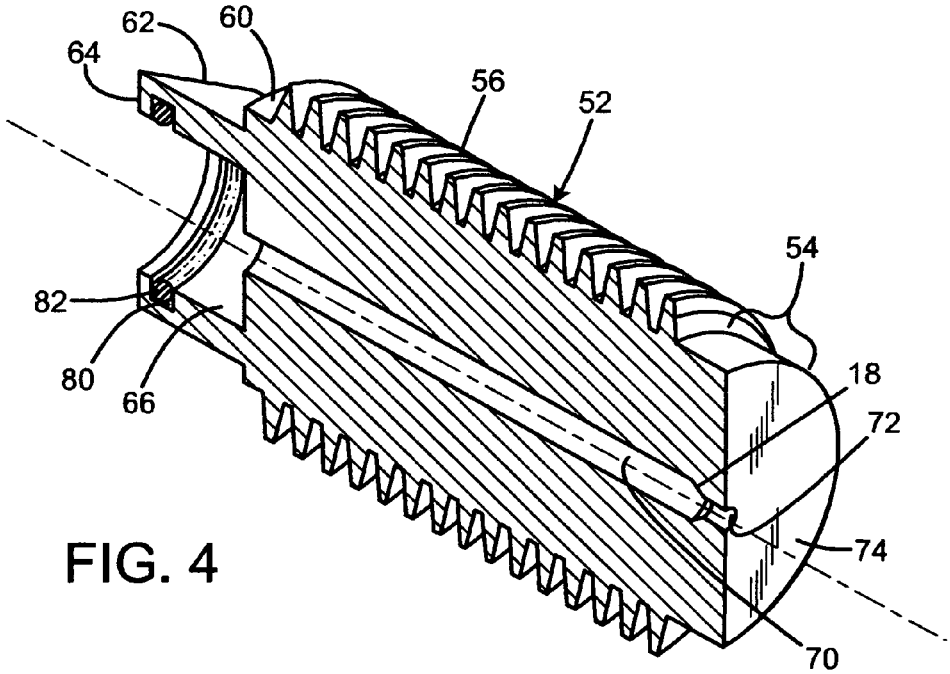
FIG. 4 is a side sectional front perspective view of the breech plug of FIG. 2.

FIGS. 3 & 4 show the breech plug 52 of the current invention removed from the rear portion of the barrel 14. More particularly, the exterior of the breech plug 52 is identical to a conventional breech plug. The breech plug 52 is a generally cylindrical body made from stainless steel with a nose portion 54 that is not threaded to closely fit in the initial portion 40 of the breech plug chamber 36. Most of the length of the plug is provided with helical threads 56 that are 5/8-18 thread. The rear or breech end portion of the breech plug has a hexagonal profile portion 62 in the shape of a bolt head. The hexagonal profile portion is separated from the helical threads by a narrow flange 60. In the current embodiment, the bolt head is 0.4375 inches wide and 0.2714 inches long. The plug's hex portion has a flat rear face 64. In the current embodiment, the breech plug 52 is 1.2304 inches long. The threaded portion 56 is 0.8130 inches long. The nose portion 54 is 0.1460 inches long and 0.5610 inches wide.

The interior of the breech plug 52 defines a central bore having a primer pocket 66 at the breech end, a generally cylindrical flash channel or fire channel 70 extending from the primer pocket through most of the length of the plug, and a narrow passage or flash hole 72 extending from the flash channel to the forward face 74 of the breech plug.

While a current embodiment of the muzzleloading firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the breech plug of the current invention can be used in any muzzleloading firearm with a 209 primer type ignition in addition to the specific break open breech type of muzzleloading firearm described. These can include falling block, bolt action, rolling block, and slam fire types. In addition, the breech plug of the current invention can be used with muzzleloading firearms using firing pins or spring-loaded forward sliding bolts instead of hammers. Furthermore, the breech plug of the current invention can have a flash channel of any design, including that of the conventional breech plug described. Also, the silicone elastomer O-ring can be replaced by a metal gas ring.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A muzzle loading firearm comprising:

a barrel with a bore defining a bore axis, and having a muzzle end and a breech end;

a frame connected to the barrel, the barrel being movable between an open position and a closed position with respect to the frame;

a breech plug removably attached to the barrel;

the breech plug including a central passage aligned with the bore axis;

the passage having an aperture at the breech end;

a primer received by the aperture;

the aperture having an interior side wall defining a circumferential groove;

the groove receiving an O-ring; and the O-ring encircles the primer, such that a portion of the primer is received within the O-ring.

2. The firearm of claim 1, wherein the O-ring encompasses the primer's cylindrical exterior to create a gas seal.

3. The firearm of claim 1, wherein the O-ring is selected from the group comprising a silicone elastomer and a metal gas ring.

4. The firearm of claim 1, wherein the O-ring has an interior diameter of less than 0.300 inches and greater than 0.175 inches and a width of less than 0.100 inches and greater than 0.020 inches.

5. The firearm of claim 1, wherein the breech end of the groove is located 0.080 inches from the breech end of the primer pocket.

6. The firearm of claim 1, wherein the O-ring retains a primer within the aperture by closely fitting a portion of the primer's cylindrical exterior that extends beyond the primer's flange.

7. The firearm of claim 1, wherein the aperture has a diameter, and the groove has an axial width nominally the diameter of the O-ring and a radial depth less than the diameter of the O-ring, which causes the O-ring to effectively decrease the diameter of the primer pocket where the O-ring bulges beyond the groove.

8. The firearm of claim 7, wherein the O-ring effectively decreases the diameter of the aperture from 0.246 inches to 0.236 inches.

9. A breech plug for a muzzleloading firearm having a barrel with a bore defining a bore axis, and having a muzzle end and a breech end comprising:

a body including a central passage aligned with the bore axis;

the passage having an aperture at the breech end;

a primer received by the aperture;

the aperture having an interior side wall defining a circumferential groove; and the groove receiving an O-ring; and the O-ring encircles the primer, such that a portion of the primer is received within the O-ring.

10. The breech plug of claim 9, wherein the O-ring encompasses the primer's cylindrical exterior to create a gas seal.

11. The breech plug of claim 9, wherein the O-ring is selected from the group comprising a silicone elastomer and a metal gas ring.

12. The breech plug of claim 9, wherein the O-ring has an interior diameter of less than 0.300 inches and greater than 0.175 inches and a width of less than 0.100 inches and greater than 0.020 inches.

13. The breech plug of claim 9, wherein the breech end of the groove is located 0.080 inches from the breech end of the primer pocket.

14. The breech plug of claim 9, wherein the O-ring retains a primer within the aperture by closely fitting a portion of the primer's cylindrical exterior that extends beyond the primer's flange.

15. The breech plug of claim 9, wherein the aperture has a diameter, and the groove has an axial width nominally the diameter of the O-ring and a radial depth less than the diameter of the O-ring, which causes the O-ring to effectively decrease the diameter of the primer pocket where the O-ring bulges beyond the groove.

16. The breech plug of claim 15, wherein the O-ring effectively decreases the diameter of the aperture from 0.246 inches to 0.236 inches.

17. A muzzle loading firearm comprising:

a barrel with a bore defining a bore axis, and having a muzzle end and a breech end;

a frame connected to the barrel, the barrel being movable between an open position and a closed position with respect to the frame;

a breech plug removably attached to the barrel;

the breech plug including a central passage aligned with the bore axis;

the passage having an aperture at the breech end;

a primer received by the aperture;

the aperture having an interior side wall defining a circumferential groove;

the groove receiving an O-ring;

a portion of the primer being received within the O-ring; and wherein the primer has a forward end, and the forward end of the primer extends beyond the O-ring.

18. The breech plug of claim 1, wherein the groove is circular.

19. The breech plug of claim 1, wherein the groove is defined by a plane perpendicular to the bore axis.

20. The breech plug of claim 9, wherein the primer has a forward end, and the forward end of the primer extends beyond the O-ring.

* * * * *